US005614689A

United States Patent [19]

Gyre et al.

[11] Patent Number: 5,614,689

[45] Date of Patent: Mar. 25, 1997

[54] AMMUNITION FEED SYSTEM AND METHOD

[75] Inventors: Christian Gyre, Chameyrat; Daniel Vieillefond, Ladignac, both of France

[73] Assignee: CTA International, Versailles, France

[21] Appl. No.: 533,195

[22] Filed: Sep. 25, 1995

[30] Foreign Application Priority Data

Sep. 30, 1994 [FR] France ..... 94 11740

[51] Int. Cl.[6] ..... F41A 9/04

[52] U.S. Cl. ..... 89/33.04; 89/33.17; 89/34

[58] Field of Search ..... 89/33.04, 33.16, 89/33.17, 33.14, 45, 46, 34

[56] References Cited

U.S. PATENT DOCUMENTS

| | | | |
|---|---|---|---|
| 3,277,787 | 10/1966 | Brieger | 89/33.04 |
| 3,995,527 | 12/1976 | Schiele et al. | 89/33.04 |
| 4,781,100 | 11/1988 | Baldwin | 89/33.04 |
| 5,070,762 | 12/1991 | Long et al. | 89/33.04 |
| 5,109,751 | 5/1992 | Hagen et al. | 89/33.16 |
| 5,115,714 | 5/1992 | Muller et al. | 89/33.16 |

FOREIGN PATENT DOCUMENTS

| | | | |
|---|---|---|---|
| 0450297A1 | 2/1991 | European Pat. Off. | 89/33.04 |
| 933264 | 4/1948 | France | 89/33.17 |
| 0571265A1 | 11/1993 | France | 89/45 |
| 2546843 | 4/1977 | Germany | 89/33.04 |
| 3805620A1 | 9/1989 | Germany . | |

*Primary Examiner*—Stephen M. Johnson
*Attorney, Agent, or Firm*—Oliff & Berridge

[57] ABSTRACT

An ammunition feed system for a firearm that can pivot in elevation about a horizontal elevation axis includes an ammunition storage device, a loading device and an intermediate transfer section. The ammunition storage device is fixed relative to the elevation axis. The ammunition storage device includes at least two magazines with a common first entry/exit opening through which the rounds of the ammunition pass. Each of the two magazines has a round transport assembly. The rounds are unconnected and selectively movable in a loading direction from the two magazines through the first entry/exit opening and in an unloading direction opposite the moving direction. The loading device individually loads the rounds into a firing chamber of the firearm and moves with the firearm in elevation. The intermediate transfer section links and transfers the rounds between the ammunition storage device and the loading device. The intermediate transfer section includes a first two-way round transfer device linked with the ammunition storage device to guide the rounds through a second entry/exit opening. A second two-way transfer device guides the rounds between the second entry/exit opening and the loading device. A drive shaft drives the first and second two-way round transfer devices and at least the respective round transfer assembly of the selected magazine. A synchronization device maintains the nonselected other of the two magazines in synchronization with the intermediate transfer section during movement of the firearm in elevation.

23 Claims, 4 Drawing Sheets

AMMUNITION FEED SYSTEM AND METHOD

BACKGROUND OF THE INVENTION

The present invention relates to an ammunition feed system for a small or medium calibre fire arm integrated into the gun shield mantlet of the turret of an armoured vehicle, for example, the said mantlet trunnioned on an axis to enable the weapon to move in elevation, this feed system being of the type which comprises at least one ammunition storage device, a loading device peculiar to the weapon to feed the munitions one by one into the firing chamber, and an intermediate section to transfer the munitions from the ammunition storage device to the loading device of the weapon.

In a conventional feed system, the munitions are generally linked together in a chain which is stored in a container forming an ammunition magazine. The intermediate section between the magazine and the loading device of the weapon is composed of one-way drive means which mesh with the chain to bring the munitions up to the loading device of the weapon in order to load them.

As a general rule, a fire arm may fire different munitions which are selected according to the nature of the target to be reached. In concrete terms, a target which appears in the firing sights of the weapon is not always identifiable in advance, given that firing efficiency is conditioned by the suitable selection of the munition to be fired at this target. In order to address this problem, one solution consists in providing two magazines containing different munitions. These two magazines are generally placed on either side of the weapon and work respectively in conjunction with two intermediate means to transfer the munitions from one or other of these two magazines to the loading device of the weapon.

Such a solution is not satisfactory from a technical point of view and also has the notable disadvantage of being cumbersome.

A new solution to the aforementioned problem is disclosed, in the French Application for Letters of Patent registered under number 94.09095 in the name of the Applicant, a solution which consists in providing an ammunition storage device formed of a single container in which two magazines are arranged each containing different munitions none of which are chain-linked together, each magazine comprising a two-way transport conveyor which supports and moves the munitions inside the magazine, and the intermediate transfer section also comprises a two-way transfer means common to both magazines and designed either to transfer the munitions from one or other of the magazines to the loading device of the weapon, or to bring the munitions being transferred towards the loading device of the weapon back to their original magazine, as well as means to select and control in synchronization the two-way transfer means of the intermediate section with one or other of the conveyors according to the munition magazine selected.

SUMMARY OF THE INVENTION

The Applicant then conducted studies to perfect such a feed system for a small or medium calibre fire arm integrated into a gun shield mantlet of a turret of an armoured vehicle, for example. If therefore at least one double magazine is provided, immobile with respect to the turret mantlet which pivots around an axis to enable the weapon to move in elevation, the feed system must notably be adapted to take the elevation movements of the weapon into account which causes a problem with regard to the synchronization of the different components of the kinematic conveyor chain which transports the munitions with respect to the unselected magazine, a problem which arises when the weapon has been moved in elevation and the gunner wishes to change the magazine. To solve such a problem, the invention thus proposes an ammunition feed system for a small or medium calibre fire arm integrated into a turret mantlet of an armoured vehicle for example, the said mantlet trunnioned on an axis to enable the weapon to move in elevation, this system being of the type which comprises at least:

one munition storage device which is immobile with respect to the turret mantlet and which is formed of at least one single container in which two magazines have been arranged having a common entry-exit opening and containing different munitions which are not chain-linked together, each magazine having a two-way transfer means which supports and displaces the munitions inside the magazine, a loading device peculiar to the weapon to load the munitions one by one into a firing chamber and which moves in elevation in conjunction with the weapon, an intermediate section to automatically transfer the munitions from the storage device and the munition loading device, and means to select one or other of the magazines, a feed system which is characterised in that it also comprises an articulated bracket mounted on the trunnion axis of the turret mantlet to follow the elevation movements of the weapon, and in that the intermediate transfer section comprises a first part having two-way transfer means, integrated into the container of the storage device, which automatically guides the munitions from one or other of the magazines to an entry-exit opening of the container, and a second part having a two-way transfer means, integrated into the articulated bracket, to automatically guide the munitions between the entry-exit opening of the container and the loading device peculiar to the weapon, the feed system being completed by means to synchronize, by means of a drive shaft, the operation of the transfer means of the selected magazine and of the intermediate section and, during the elevation movement of the weapon, by means to keep the transfer means of the unselected magazine and the transfer means of the first part of the intermediate section in synchronization when this magazine is once again selected.

The two-way transfer means of each magazine is constituted by a conveyor having two endless chains which wind respectively around two upper pinions carried by a shaft and around two lower pinions carried by a shaft, these two shafts being parallel to the trunnion shaft of the turret mantlet.

The first part of the intermediate transfer section is arranged in an upper part of the container located above the entry-exit opening which is common to both magazines, and comprises a first starwheel, a conveyor having two endless chains and a second starwheel placed between the first wheel and the conveyor, to automatically guide the munitions between one or other of the magazines and the entry-exit opening of the container.

According to one embodiment, the first starwheel is supported by a shaft parallel to the trunnion shaft of the turret mantlet and is located in the vicinity of the entry-exit opening of the magazines either to receive the munitions guided by the two-way transfer means of the selected magazine, or to return the munitions towards their original magazine, whereas the second starwheel is supported by a shaft which is parallel to the shaft of the first starwheel, and is designed to ensure the transfer of the munitions between the first starwheel and the conveyor having two endless chains, and the two starwheels are driven simultaneously in two different rotational directions by means of a gear formed of two pinions respectively integral with the two support shafts of the two starwheels.

As a general rule, the articulated bracket is formed of a hollow body open at both ends and inside which the second part of the intermediate transfer section is housed.

According to one embodiment, the second part of the intermediate transfer section is integrated into the articulated bracket and is formed of a conveyor having two endless chains, wherein one end is located in the vicinity of the entry-exit opening of the container and the other end is located in the vicinity of the entry to the loading device of the weapon, the two endless chains winding respectively, on the side of the first part of the intermediate transfer section around two pinions carried by a first shaft and, on the side of the loading device of the weapon, around two pinions carried by a second shaft.

To ensure a continuous kinematic chain between the ammunition storage device and the device to feed the munitions into the firing chamber of the weapon, a connecting gear train is provided between the two parts of the intermediate transfer section, whereas the continuity of the kinematic chain between the first part of the intermediate transfer section located in the container and one or the magazines or the magazine selected is ensured by selection means of one or other of these magazines.

The conveyors of these two parts of the intermediate transfer section are driven simultaneously by means of a gear train formed of two coupling pinions.

The means to select one or other of the magazines comprise two drive pinions working respectively with the two conveyors of the two magazines, and a coupling device to couple the first starwheel in rotation with the corresponding pinion for the selected magazine.

When the weapon moves in elevation, the first part of the intermediate transfer section housed in the container remains immobile whereas its second part housed in the bracket moves in elevation with the weapon. As a result of this there is a relative movement between the two parts of the intermediate transfer section which has an effect upon the part of the kinematic chain in the container. In these circumstances, the driving pinion of the conveyor of the unselected magazine, which is separated from the kinematic chain, risks no longer being in synchronization with the kinematic chain when the said magazine is once again selected.

The means to keep the synchronization, during an elevation movement of the weapon, between the transfer means of the unselected magazine and the transfer means of the first part of the intermediate transfer section when this magazine is once again selected, comprise two mobile rectilinear racks housed in the container working respectively with the two drive pinions of the two magazines, each rack meshing with a coupling pinion coaxial to the trunnion shaft of the bracket and fastened to a lever which is integral with the bracket, and with the driving pinion of the unselected magazine, whereas the driving pinion of the selected magazine meshes with the coupling pinion integral in rotation with the first starwheel, the two racks being displaced in two opposing directions when the shaft moves in elevation.

A shaft of the conveyor integrated into the articulated bracket is, for example, the drive shaft of the kinematic chain of the feed system, this shaft being able to be driven either by the shaft motor or by an auxiliary motor.

As a general rule, the kinematic chain can operate in two directions according to whether the drive shaft rotates one way or the other. The weapon thus functions in the feed phase when the munition are guided between one of the magazines and the device which feeds these munitions into the weapon, and functions in the reverse-feed phase before the other magazine can be selected. In fact, the munitions located in the intermediate transfer section must be brought back to their original magazine before the other magazine can be selected. It is therefore preferable to count the munitions exiting from a magazine when the weapon is functioning in the feed phase so as to know thereafter how many of these munitions must be brought back to their original magazine before selecting the other magazine.

The feed system thus comprises a device to count the munitions exiting by the entry-exit opening of the magazines.

According to one embodiment, the counting device comprises a detection component to count the bosses made radially on one face of the coupling pinion integral in rotation with the first starwheel, the detection component being carried by a disk-shaped plate wherein the periphery is indented, this plate being supported in rotation by the shaft of the first starwheel, whereas the toothing of the plate is designed to mesh with the driving pinion of the unselected magazine.

Lastly, it is possible to integrate at least a third ammunition magazine to the ammunition storage device, this third magazine being integral with the articulated bracket and the direction of the munition being carried out by means of the second part of the intermediate transfer section housed in the bracket.

According to a first advantage of the invention, it is possible to automatically feed a fire arm from at least two magazines containing different munitions, preferably arranged inside a single container, using only one transfer chain to guide the munitions from one or other of the munitions to the device which feeds these munitions into the weapon.

According to another advantage of the invention, the feed system is compact and may be mounted on several types of fire arms, in particular those integrated into a turret mantlet of an armoured vehicle.

BRIEF DESCRIPTION OF THE DRAWINGS

Other advantages, characteristics and details of the invention will become apparent from the explanatory description which follows, made with reference to the appended drawings given by way of illustration and wherein.

DETAILED DESCRIPTION OF PREFERRED EMBODIMENTS

Figure 1:
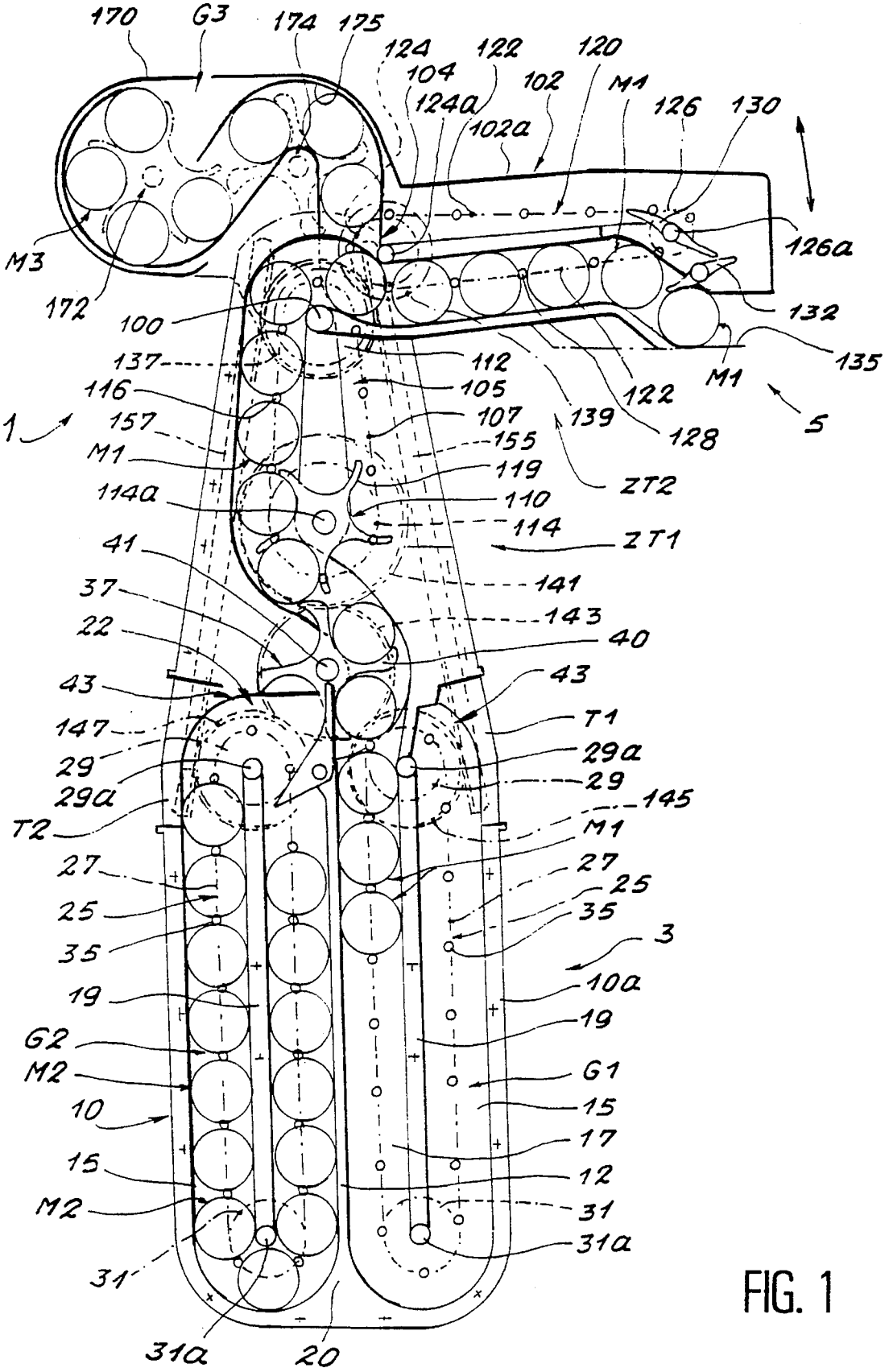
FIG. 1 is a skeleton view of a feed system according to the invention which automatically guides the munitions between one or other of the two storage magazines and a device which feeds these munitions into the weapon.

The feed system 1 shown in FIG. 1 is notably designed for a small or medium calibre fire arm integrated into a turret mantlet of an armoured vehicle, for example.

Conventionally, the turret mantlet which supports the weapon is trunnioned on a horizontal axis physically represented by a shaft 100 supported by a turret cradle to enable the weapon to move in elevation, and the cradle itself is mounted rotating around a vertical axis to enable the weapon to move traversely.

The feed system 1 notably comprises an ammunition storage device 3, a device 5 peculiar to the weapon which feeds the munitions one by one into a firing chamber, and an intermediate section ZT1 and ZT2 which automatically transfers the munitions between the storage device 3 and the loading device 5 of the weapon.

The storage device 3 comprises a container 10 globally shaped like a parallelepiped rectangle. Two magazines G1 and G2 containing different munitions M1 and M2 are arranged inside the container 10.

The two magazines G1 and G2 are arranged on either side of a vertical central partition 12 which separates the inner volume of the container 10 longitudinally into two parts. The container 10 is of a length greater than that of the munitions M1 and M2.

Two elevation corridors respectively outer 15 and inner 17 are demarcated in each magazine G1 and G2 by means of an intermediate vertical wall 19 parallel to the central partition 12.

More precisely, for magazine G1, for example :

the outer passage 15 is demarcated between the longitudinal elevation wall 10*a* of the container 10 which borders the magazine G1 and the intermediate elevation wall 19 of the magazine G1, and the outer passage 17 is demarcated between the intermediate vertical wall 19 of the magazine G1 and the central vertical wall 12 which separates the two magazines G1 and G2.

The two corridors 15 and 17 of the magazine G1 are of a width which is slightly greater than the diametre of the munitions which they must store. At their lower ends, the two corridors 15 and 17 intercommunicate by means of a semi-circular part 20 arranged in the bottom wall of the container 10. At their upper ends, the two corridors 15 and 17 open out inside the container 10 by a single entry-exit opening 22. This opening 22 is of a length and width greater than those of the munitions M1 and M2 to enable the munitions to pass through unhindered.

The arrangement of magazine G2 is identical to that of magazine G1, and the two outer 15 and inner 17 corridors of magazine G2 also open out, at their upper ends, inside the container 10 by the entry-exit opening 22.

The munitions M1 and M2 are designed to be stored horizontally and one on top of the other in the corridors 15 and 17 of the two magazines G1 and G2, these munitions not being chain-linked together.

Each magazine G1 and G2 is fitted with a two-way transfer means to support and displace the munitions M1 and M2 inside the magazine.

The munitions M1 and M2 are loaded in magazines G1 and G2 by traps T1 and T2 provided in the longitudinal walls 10*a* of the container 10.

This two-way transfer means is, for example, formed by a conveyor 25 having two endless chains 27. The two chains 27 of each conveyor 25 extend in parallel to one another and each wind around two pinions respectively upper 29 and lower 31. The pinions 29 and 31 separate each chain into two bits and are arranged in such a way that each bit of the chain 25 may move freely in the outer passage 15 of the corresponding magazine G1 or G2, whereas the other bit of this chain 27 may freely move in the inner passage 17 of the corresponding magazine G1 or G2. The two upper pinions 29 of the two chains 27 are supported by and are integral in rotation with a single shaft 29*a*, whereas the two lower pinions 31 are supported by and are integral with a single shaft 31*a*, such that the two chains 27 of each conveyor 25 are driven in synchronization. The ends of the shafts 29*a* and 31*a* of each conveyor 25 are accommodated by bearings supported by the side walls of the container 10, for example. The two endless chains 27 of each conveyor 25 are fitted with radial catches 35 which are designed to support munitions M1 and M2, the distance separating two adjacent catches 35 being slightly greater than the diametre of the munitions M1 and M2.

The representation of the loading device 5 of the weapon is voluntarily given in skeletal form, given that it is peculiar to the type of weapon under consideration, and that the storage device 3 of the munitions and the intermediate transfer section ZT1 and ZT2 form an assembly which can work with different types of feed devices to load the munition into the firing chamber of the weapon.

The intermediate munition transfer section globally comprises two parts ZT1 and ZT2 which are respectively integrated into the container 10 and into an articulated bracket 102. One end of the bracket 102 is mounted hinged onto the trunnion shaft 100 of the weapon to follow the movements in elevation of the weapon, and its other end works in conjunction with the entry of the device 5 which loads the munitions into the firing chamber of the weapon.

In these circumstances, the second part ZT2 of the intermediate munition transfer section, which is integrated into the bracket 102, moves in elevation with the weapon, whereas the first part ZT1 of this intermediate transfer section, which is integrated into the container 10, remains immobile when the weapon moves in elevation.

The first part ZT1 of the intermediate section is arranged in an upper part of the container 10 which is located above the two magazines G1 and G2, and comprises two-way transfer means which automatically guide munitions M1 and M2 from one or other of the two magazines between the entry-exit opening 22 common to these two magazines and an entry-exit 104 provided in the upper part of the container 10.

These two-way transfer means are formed of a first starwheel 37, a conveyor 105 having two endless chains 107 and a second starwheel 110 placed between the first wheel 37 and the conveyor 105. The starwheel 37 (FIG. 2) comprises two stars 39 having four points 40, which are supported by and integral in rotational with a bearing shaft 41. The two stars 39 are separated from one another by a distance which is less than the length of munitions M1 and M2 so as to partially receive the latter. The starwheel 37 is mounted at the entry-exit opening 22 of magazines G1 and G2 so as to automatically receive munitions M1 or M2 transported by the conveyor 25 of the selected magazine. The shaft 41 which carries the starwheel 37 is supported in rotation by the container 10 and extends in parallel to the shafts 29*a* and 31*a* of the two conveyors 25 of magazines G1 and G2.

Each longitudinal side of the entry-exit opening 22 of the container 10 is partly bordered by a casing 43 shaped like the arc of a circle to retain and guide munitions M1 and M2 during their transfer between the conveyor 25 of the selected magazine and the starwheel 37.

The two endless chains 107 of the conveyor 105 extend in parallel to one another and each wind around two pinions respectively upper 112 and lower 114. The two upper pinions 112 are supported in rotation by the trunnion shaft 100 of the turret mantlet, whereas the two lower pinions 114 are supported by and are integral with a single shaft 114*a*, such that the two chains 107 are driven in synchronization. The ends of the shaft 114*a* of the conveyor 105 are housed in bearings supported by the side walls of the container, for example.

The two endless chains 107 of the conveyor 105 are fitted with radial catches 116 which are designed to support munitions M1 or M2, the distance separating two adjacent catches 116 being slightly greater than the diametre of a munition. The conveyor 105 is bordered by the two longitudinal walls 10a of the container 10 so that the munitions are retained and guided during their transfer.

The upper pinions 112 of the conveyor 105 are located in the upper part of the container 10 at the entry-exit opening 104 so as to be able to extract the munitions from the container 10.

The second starwheel 110 (FIG. 2) is carried by the shaft 114a and is integral in rotation with the lower pinions 114 of the conveyor 105. This second starwheel 110 also comprises two stars 118 having four points 119 which are separated from one another by a distance which is less than the length of munition M1 and M2. The second starwheel 110 is designed to turn in the opposite direction to that of the first starwheel 37 so as to ensure the automatic transfer of the munitions between the starwheel 37 and the conveyor 105.

As a general rule, the bracket 102 is formed of a hollow body 102*a* which is open at both ends and which extends between the entry-exit opening 104 of the container 10 and the entry of the device 5 which feeds the munitions into the weapon, and the second part ZT2 of the intermediate transfer section is housed inside this hollow body 102*a*.

This second part ZT2 comprises a two-way transfer means which automatically guides munitions M1 and M2 between the entry-exit opening 104 of the container 10 and the entry of the loading device 5 of the weapon.

This two-way transfer means is formed of a conveyor 120 having two endless chains 122. The two chains 122 extend in parallel to one another and both wind around two pinions 124 and 126. The two pinions 124 are supported by and are integral in rotation with a single shaft 124*a*, whereas the two pinions 126 are supported by and are integral with a single shaft 126*a*, so that the two chains 122 of the conveyor 120 are driven in synchronization. The shafts 124*a* and 126*a* are parallel to the trunnion shaft 100 of the turret mantlet. The ends of the shafts 124*a* and 126*a* of the conveyor 120 are housed in bearings supported by the side walls of the body 102*a* of the bracket 102.

The two endless chains 122 of the conveyor 120 are fitted with radial catches 128 which are designed to retain munitions M1 and M2, the distance separating two adjacent catches 128 being slightly greater than the diametre of the munitions, and the conveyor 120 is bordered by two longitudinal walls of the body 102*a* so that the munitions are retained and guided during their transfer.

The upper pinions 112 of the conveyor 105 and the pinions 124 of the conveyor 120 are positioned on either side of the entry-exit opening 104 of the container 10, so that munitions M1 or M2 may be automatically transfered from one conveyor to the other.

The transfer of munitions M1 and M2 between the conveyor 120 of the articulated bracket 102 and the entry of the device 5 which feeds the munitions into the weapon, is carried out by means of the two starwheels 130 and 132.

The starwheel 130 is mounted on the shaft 126*a* of the conveyor 120, whereas the starwheel 132 is mounted at a lower level between the starwheel 130 and a section 135 to position the munition M1 or M2. These two starwheels 130 and 132 thus ensure the transfer of the munitions between the conveyor 120 and the positioning section where a munition M1 or M2 lies in alignment with the axis of the loading chamber and firing chamber before being fed into this chamber. The two starwheels 130 and 132 revolve in the same direction by means of gears which are not shown.

To achieve continuity of the kinematic chain which transfers the munitions between the storage device 3 and the device 5 to feed the munitions, several connecting gear trains have been provided.

One gear train formed of two coupling pinions 137 and 139 meshing with one another ensure a kinematic connection between the two parts ZT1 and ZT2 of the intermediate transfer section, i.e. to drive the conveyor 105 housed in the container 10 in synchronization with the conveyor 120 housed in the articulated bracket 102. The coupling pinion 137 is housed inside the container 10, mounted on the trunnion shaft 100 of the turret mantlet and integral in rotation with the upper pinions 112 of the conveyor 105. The coupling pinion 139 is housed in the bracket 102, mounted on the shaft 124*a* of the conveyor 120 and integral in rotation with pinions 124 of this conveyor 120.

A gear train formed by two coupling pinions 141 and 143 meshing with one another ensures a kinematic connection between the two starwheels 37 and 110 of the first part ZT1 of the intermediate transfer section. The pinion 141 is integral in rotation with the shaft 114a which carries the starwheel 110 and the lower pinions 114 of the conveyor 105, whereas the pinion 143 is integral in rotation with the shaft 41 which carries the starwheel 37.

Lastly, two coupling pinions 145 and 147 are designed to mesh selectively with pinion 143 according to whether magazine G1 or G2 has been selected, i.e. to drive the starwheel 37 and the conveyor 25 of the selected magazine in synchronization. The pinion 145 is carried by the upper shaft 29*a* of the conveyor 25 of magazine G1 and is integral in rotation with the pinions 29 which support the chains 27 of this conveyor 25. In a similar manner, the pinion 147 is carried by the shaft 29*a* of the conveyor 25 of magazine G2 and is integral in rotation with the pinions 29 which support the chains 27 of this conveyor 25.

When magazine G1 is selected, the coupling pinion 145 meshes with the pinion 143 which is integral in rotation with the starwheel 37, whereas pinion 147 meshes with pinion 143 when magazine G2 is selected.

A coupling control device 150 is provided so as to selectively mesh pinion 143 working in conjunction with magazine G1 or pinion 147 working in conjunction with magazine G2 so as to select magazine G1 or G2.

Figure 3:
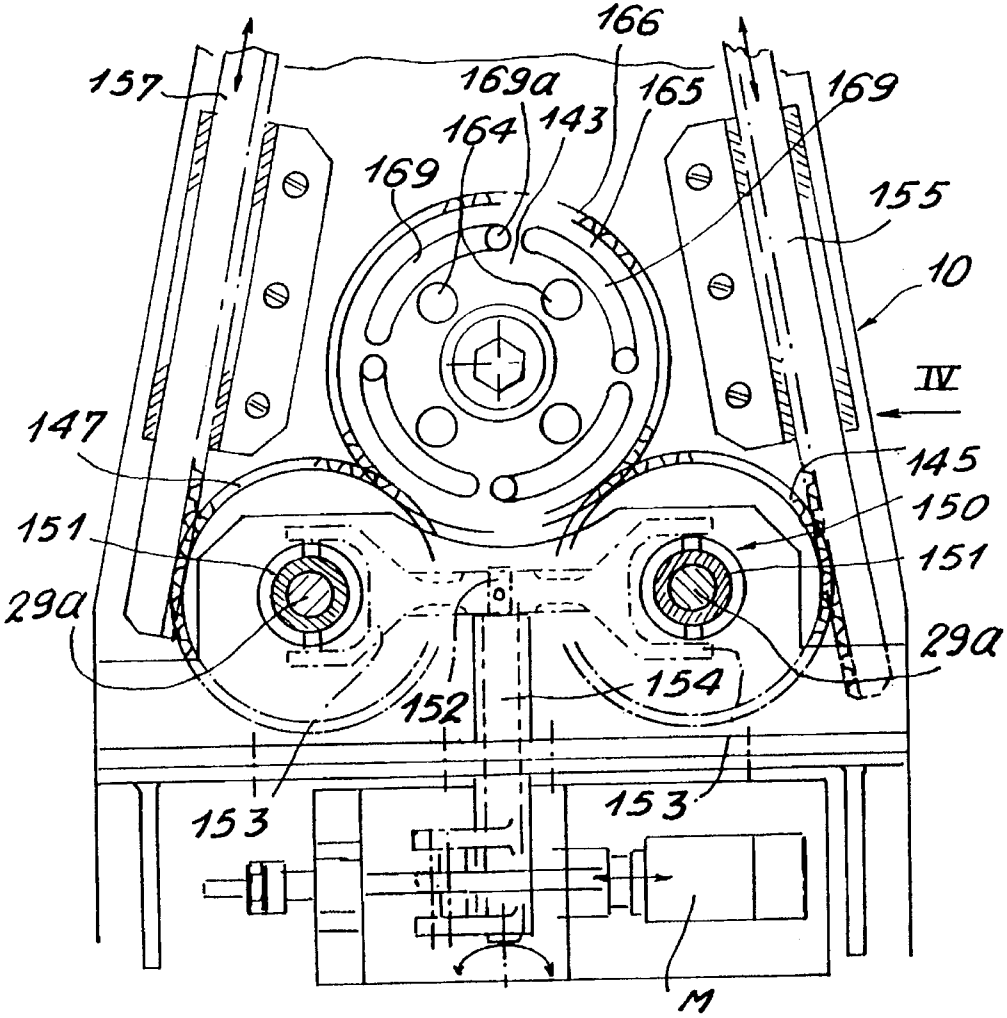
FIG. 3 is a partial cross-section of the synchronization means required for the feed system to operate when the weapon moves in elevation.

With reference to FIG. 3, the coupling control device 150 comprises a bushing 151 which is mounted sliding by means of ribbing on each of the two upper shafts 29a of the conveyors 25, such that the two coupling pinions 145 and 147 are in fact respectively supported by and integral with the two bushing 151. The coupling control device 150 also comprises a bracket 152 finished off at each end by a fork 153, the two forks 153 engaging respectively in two ring-shaped grooves arranged around the periphery of the bushing 151. Lastly, in its central part, the bracket 152 is hinged on a shaft 154 driven in rotation by a motor M assembly so as to translate the two bushing 151 in two opposing directions.

Thus, when the pinion 145 is brought to mesh with the pinion 143 which is integral in rotation with the starwheel 37 (magazine G1 selected), the pinion 147 is uncoupled from the pinion 143 (magazine G2 unselected).

Supposing that magazine G1 is selected, a continuous kinematic chain exists between this magazine G1 and the entry to the loading device 5 of the weapon. This kinematic chain may be mobilised by a single drive shaft which, in the example under consideration here, is shaft 126*a* of the conveyor 120 housed in the articulated bracket 102.

In this event, the rotation of the drive shaft 126*a* successively drives:

- the mobilisation of the conveyor 120 of the bracket 102 and the rotation of the coupling pinion 139 working in conjunction with this conveyor,
- the rotation of the pinion 137 meshed with the pinion 139, these two pinions ensuring the kinematic connection between the two parts ZT1 and ZT2 of the intermediate transfer section,
- the mobilisation of the conveyor 105 of the container 10 by means of the pinions 112 which are integral in rotation with the pinion 137,
- the rotation of the starwheel 110 which is integral in rotation with the lower pinions 114 of the conveyor 120,
- the rotation of the pinion 141 which is integral in rotation with the starwheel 110,
- the rotation of the pinion 143 and of the starwheel 37 which is integral in rotation with the pinion 143,
- the rotation of the pinion 145 meshed with the pinion 143, these two pinions ensuring the kinematic connection between the first part ZT1 of the intermediate transfer section and the selected magazine G1, and
- the mobilisation of the conveyor 25 of the magazine G1 by means of the upper pinions 29 which are integral in rotation with the pinion 145.

This continuous kinematic chain between the conveyor 25 of magazine G1 and the loading device 5 of the weapon enable the munitions M1 stored in magazine G1 to be automatically guided to the loading and firing chamber in the following manner, this supposing that the weapon is laid at a pre-determined elevation laying angle.

The mobilisation of the conveyor 25 of the magazine G1 (FIG. 1) displaces the munitions M1 inside the magazine towards the entry-exit opening 22 common to both magazines G1 and G2. Each munition M1 which exits, for example, via the outer passage 15 of magazine G1 is transferred between two adjacent points 40 of each of the two stars 39 of the starwheel 37. The munition M1 is thereafter transferred from starwheel 37 to starwheel 110, then guided by the conveyor 105 up to the entry-exit opening 104 located in the upper part of the container 10. The munition is then picked up by the conveyor 120 of the articulated bracket 102 to be guided up to the loading device 5 of the weapon.

In this last phase, the munition M1 which reaches the end of the conveyor 120 is picked up by the starwheel 130 which is integral in rotation with the drive shaft 126*a*. The munition M1 is finally received by the starwheel 132 which retains it during its downward movement towards section 135 where the munition is positioned.

As a general rule, the continuous kinematic chain which enables a succession of munitions M1 stored in magazine G1 to be transferred to the loading device 5 of the weapon may, with advantage, operate in the opposite direction, i.e. to bring the munitions M1 back from the positioning section 135 to magazine G1, this operation being required when the gunner decides to fire the munitions M2 stored in magazine G2 and when munitions M1 are located between the entry-exit opening 22 of the magazines and the positioning section 135, as will be explained hereafter.

Supposing that the weapon is not in action, i.e. that the kinematic chain of the feed system is innmobile, and that the gunner activates an elevation of the weapon so as to aim at a target before firing munitions from the magazine G1 which was already selected for the previous fire.

When the weapon is moved in elevation, the movements of the weapon are transmitted to the articulated bracket 102 which pivots around the trunnion shaft 100. The pinion 139, which is located next to the bracket 102 is meshed with the pinion 137 located next to the container 10, and ordinarily ensures that this movement is transmitted between the first ZT1 and second ZT1 parts of the intermediate transfer section. As the pinion 139 is locked in rotation by the drive shaft 126*a*, the rotation of the bracket 102 cause the pinion 137, which is meshed with the pinion 139, to rotate. This rotational movement has an automatic effect upon the part of the kinematic chain located inside the container 10. As a result, the munitions M1 located in the first part ZT1 of the intermediate transfer section and in the selected magazine G1, are all displaced in one direction or another according to which way the bracket 102 rotates.

However, during this elevation of the weapon which notably drives a rotational movement of the starwheel 37, the points 40 of this starwheel 37 shift angularly with respect to the first munition M2 of the unselected magazine G2 which will be the first munition extracted from this magazine by the starwheel 37 when the gunner has decided to select it. Such an angular shift may cause a desynchronization between the transfer means of the first part ZT1 of the intermediate transfer section and the transfer means of the unselected magazine G2. This desynchronization may cause the kinematic chain to misfunction when the pinion 145 working in conjunction with the magazine G2 has to mesh with the pinion 143 working in conjunction with the starwheel 37, the teeth of these pinions not being correctly positioned with respect to one another. To meet such a disadvantage, the feed system 1 according to the invention is also fitted with means to keep this synchronization, further to an elevation of the weapon.

Figure 5:
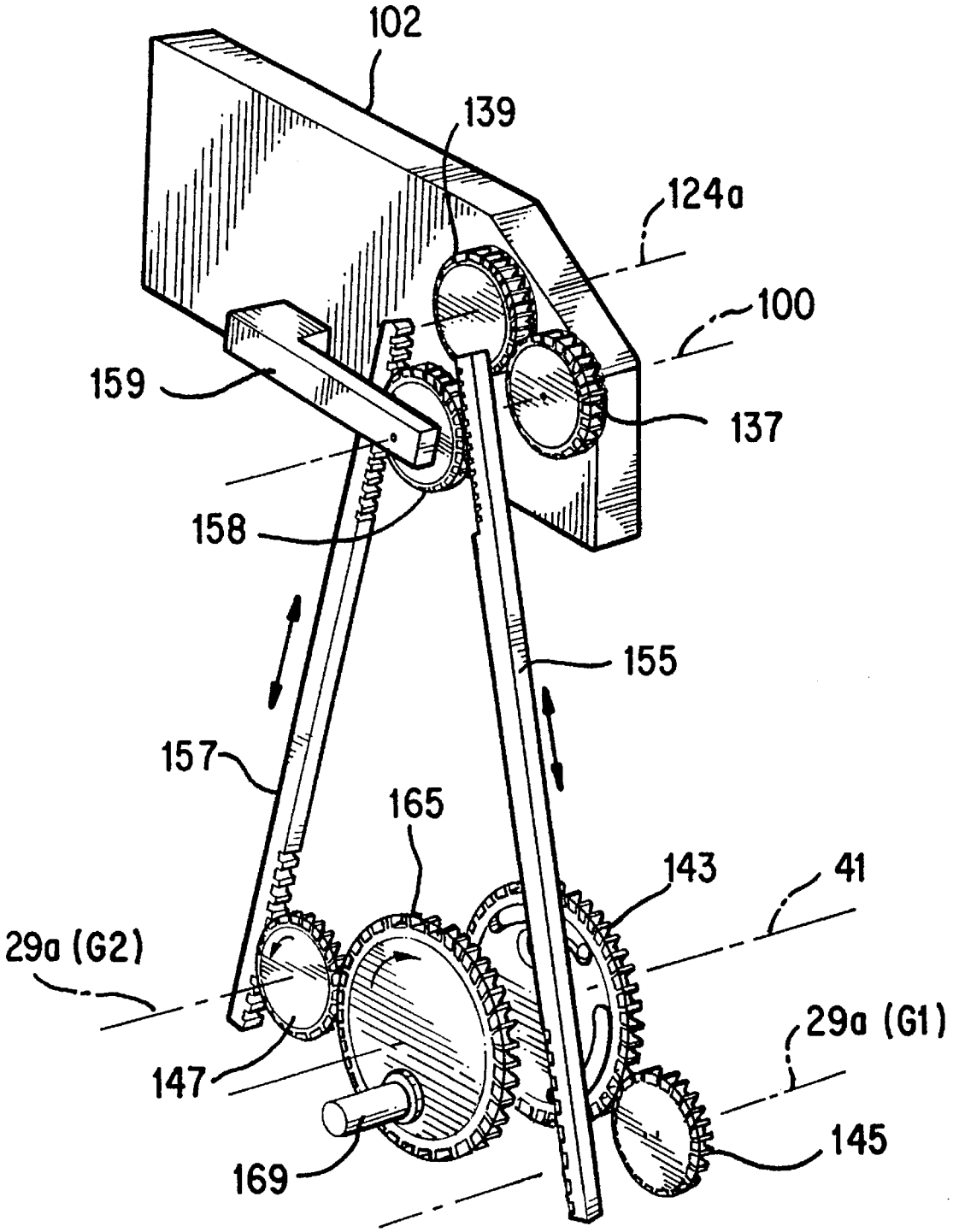
FIG. 5 is a partial perspective view of the synchronization means shown in FIG. 3.

With respect to FIG. 3 and 5, these synchronization means comprise two rectilinear racks 155 and 157 housed in the container 10.

More precisely, one end of the rack 155 is meshed with a pinion 158 which is coaxial to the trunnion shaft 100 of the shaft and is fastened to a lever 159 integral with the bracket 102, whereas the other end of the rack 155 is designed to mesh with the pinion 145 working in conjunction with the magazine G1, when this magazine is not selected, i.e. when the pinion 145 is not meshed with the pinion 143 working with the starwheel 37. In a similar way, one end of the rack 157 is meshed with the pinion 158, whereas its other end is designed to mesh with the pinion 147 when magazine G2 is not selected, i.e. when pinion 147 is not meshed with the pinion 143 working in conjunction with the starwheel 37.

Thus, when the weapon moves in elevation, the rotation of the pinion 158 causes the two racks 155 and 157 to move in two opposing directions, being guided along two slides arranged in the container 10.

When magazine G1 is selected, the pinion 147 which controls the mobilisation of the conveyor 25 of magazine G2 and which is separated from the kinematic chain, will nevertheless be driven in rotation further to the linear displacement of the rack 155, such that the angular shift resulting from the elevation of the weapon is fully transmitted to the pinion 147.

This rotation of the pinion 147 drives the mobilisation of the conveyor 25 of magazine G2, such that the munitions M2 are displaced inside the magazine in a direction which depends on the rotational direction of the articulated bracket 102.

This results in a relative displacement of the first munition M2, ready to be extracted from the magazine G2, which corresponds to the angular shift of the points 40 of the starwheel 37. In these circumstances, when the magazine G2 is selected by the gunner, the synchronization is maintained between the kinematic chain and the driving pinion 147 of the conveyor 25 of magazine G2 not yet selected.

Let us suppose now that the weapon is in action and is firing munitions, i.e. that the kinematic chain of the feed system is in movement further to the rotation of the drive shaft 126*a* to guide the munitions M1 from magazine G1 to the loading device 5 of the weapon, which feeds them one by one into the firing chamber, and that at the same time the gunner modifies the elevation angle of the weapon to follow a mobile target, for example.

When the kinematic chain is in movement, the two pinions 137 and 139, which ensure the kinematic connection between the two parts ZT1 and ZT2 of the intermediate transfer section, revolve in synchronization driven by the drive shaft 126*a*.

The elevation movement of the weapon is transmitted to the bracket 102 and as a result there will be an increase or decrease in the speed of the pinion 137 located in the immobile container 10 with respect to the pinion 139 located on the bracket 102 side, which also elevates. In these circumstances, the movement of the transfer means located in the first part ZT1 of the intermediate transfer section and those of the selected magazine G1 will be either accelerated or slowed down which will in turn lead to a desynchronization of these transfer means with respect to those of the unselected magazine G2. The aforesaid means to keep this synchronization are activated once again and this in the same manner via the racks 155 and 157.

As indicated hereabove, the kinematic chain of the feed system 1 may operate in a direction, which corresponds to the feed phase of the weapon to guide the munitions M1 or M2, according to whether magazine G1 or G2 has been selected, to the loading device 5 of the weapon, but may also operate in the opposite direction, which corresponds to a reverse-feed phase to bring the munitions M1 or M2, which are present in the intermediate transfer section TZ1 or TZ2, back towards their original magazine and to do this the rotational direction of the drive shaft 126*a* merely has to be reversed thereby mobilising the kinematic chain of the feed system 1. The reverse-feed phase of the weapon is required when the gunner decides to select the other magazine or magazine G2, for example, when munitions M1 already extracted from magazine G1 are still present in the intermediate transfer section ZT1 and TZ2 between the entry-exit opening 22 of the magazines and the loading device 5 of the weapon.

In this reverse-feed phase of the weapon, note that the starwheel 132, placed between the conveyor 120 integrated into the bracket 102, no longer functions as a support to retain the munitions in their downward movement towards the positioning section 135, but enables a munition which is in this positioning section 135 to be retracted and brought back up to the starwheel 130, and replaced between two catches 128 of the conveyor 120 in order to bring it, and those munitions which preceded it, back to magazine G1.

However, when the system is in the feed phase of the weapon, i.e. when the munitions are guided towards the loading device 5 of the weapon, a device is provided to count the number of munitions M1 or M2, which are extracted from the selected magazine, in order to know the number of munitions having to be brought back to their original magazine during the reverse-feed phase and before selection of the other magazine.

Figure 4:
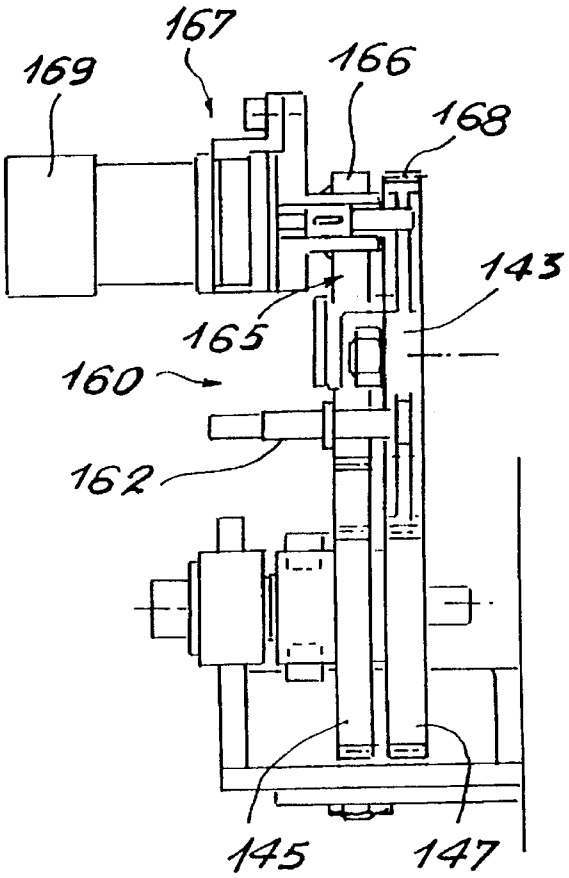
FIG. 4 is a view following the arrow IV in FIG. 3.

With reference to FIGS. 3 and 4, the counting device 160 of the munitions M1 or M2 extracted from their respective magazines G1 or G2, comprises a detection component such as a proximity sensor 162 connected to an electronic control. The sensor 162 detects and counts the bosses 164 positioned radially on one face of the pinion 143, which is integral in rotation with the starwheel 37.

The sensor 162 is carried by a disk-shaped plate 165 having toothing 166 around its periphery. The plate 165 is mounted freely rotating around the shaft 41 of the starwheel 37 and its toothing 166 is designed to mesh with pinion 145 if magazine G2 is selected and with pinion 147 if magazine G1 is selected.

Thus, the angular shift of the starwheel 37, which is the result of an elevation movement of the weapon, is also transmitted to the revolving plate 165 such that the proximity sensor 162 undergoes the same angular shift as the holes 164 of the starwheel 37 to avoid any counting errors.

To summarize, if magazine G1 is selected:

the driving pinion 145 of the conveyor 25 of magazine G1 meshes with the pinion 143 which is integral in rotation with the starwheel 37, and the driving pinion 147 of the conveyor 25 of the magazine G2 is uncoupled from the pinion 143 but meshes with its corresponding rack 157 and the toothing 166 of the revolving plate 165.

Then, when magazine G2 is selected by acting on the coupling control device 150 :

the driving pinion 147 of the conveyor 25 of magazine G1 meshes with the pinion 143 which is integral in rotation with the starwheel 37, and the driving pinion 145 of the conveyor 25 of magazine G2 is uncoupled from the pinion 143 and comes to mesh with its corresponding rack 155 and the toothing 166 of the revolving plate 165.

When the gunner decides to change magazines, he must first empty the weapon, i.e. bring the munitions present in the transfer sections ZT1 and ZT2 back to their original magazine G1 or G2. In order to do this, the movement of the kinematic chain is reversed by the rotation of the drive shaft 126a in the opposite direction.

Having said that, further to the inertia of the munitions M1 and M2, when the last munition is brought back to its original magazine by the starwheel 37 located in the vicinity of the entry-exit opening 22 of magazines G1 and G2, this last munition may cause a slight angular shift of the starwheel 37. Such an angular shift must be avoided as it is likely to cause a problem with the synchronization between the pinion 143 integral in rotation with the starwheel 37 and the pinion 145 or 147 with which it must come to mesh when the other magazine is selected once the weapon has been vacated.

The feed system may thus be advantageously fitted with a safety device 167 designed to lock the pinion 143 integral in rotation with the starwheel 37 when the last munition re-enters its original magazine G1 or G2 upon leaving the starwheel 37, this moment marks the end of the reverse-feed phase of the weapon when the drive shaft 126*a* of the kinematic chain is stopped in rotation.

Figure 2:
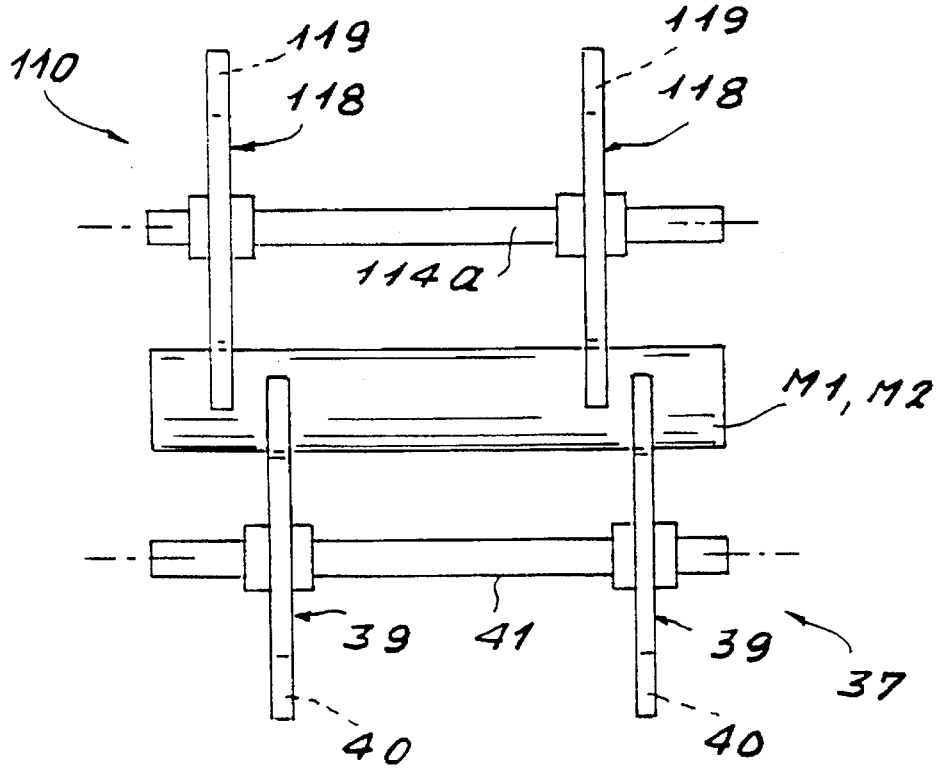
FIG. 2 is a detailed view of the two starwheels integrated into an intermediate section to transfer the munitions between the storage magazines and the device which feeds these munitions into the weapon.

With reference to FIGS. 2 and 3, this safety device 167 is formed of a mobile pin 168 and by a control electromagnet 169, which are both carried by the plate 165 of the counting device 160. This plate 165 is coaxial to the pinion 143 integral in rotation with the starwheel 37, and the pin 168 is designed to engage in one of several curved grooves 169 machined in the body of the pinion 143, each groove ending in a hole 169*a*. In concrete terms, when the counting device 160 counts the last munition which must be brought back to its original magazine, the pin 168 is activated by the electromagnet 169 in order to engage in one of the grooves 169 of the pinion 143 so as to penetrate in the hole 169*a* of this groove when the last munition leaves the starwheel 37. The pinion 143 is thus immobilised in rotation as is the kinematic chain further to the immobilisation in rotation of the drive shaft 126*a*.

After this locking operation, the coupling control device 150 is activated to select the other magazine. Once the other magazine has been selected, the electromagnet 169 is once again activated to disengage the pin 168 and unlock the pinion 143. Thereafter, the drive shaft 126*a* is activated in rotation to guide the munitions from the selected magazine towards the loading device 5 of the weapon.

As a general rule, the drive shaft 126*a* of the kinematic chain of the feed system 1 can be driven by the weapon's motor or by an auxiliary motor.

As an alternative to the embodiment hereabove described, the ammunition storage device 3 may be fitted with a third magazine G3 containing munitions M3.

In this alternative embodiment shown in FIG. 1, magazine G3 is arranged inside a container 170 integral with the articulated bracket 102. Two starwheels 172 and 174, whose axes are parallel to the trunnion shaft 100 of the turret mantlet, are mounted in the container 170. The munitions M3 are partially housed in the respective points of these two starwheels 172 and 174, which are driven in two opposite rotational directions. The exit to the container 170 is formed by a passage 175, which opens out at the conveyor 120 of the articulated bracket 102, to guide the munitions M3 towards the loading device of the weapon.

As magazine G3 is integral with the articulated bracket, i.e. it revolves around the trunnion shaft 100, no compensation whatsoever is required to be made for any angular shift caused by the elevation movement of the weapon.

We claim:

1. An ammunition feed system for a firearm pivotable in elevation about a horizontal elevation axis, the system comprising:

an ammunition storage device fixed relative to the elevation axis and having two magazines with a common first entry/exit opening through which rounds of ammunition individually pass, each of the two magazines having a round transport assembly on which the rounds are selectively movable in a loading direction from a selected one of the two magazines through the first entry/exit opening and in an unloading direction opposite the moving direction;

a loader that individually loads the rounds into a firing chamber of the firearm, the loader being connected to and disposed to pivot in elevation with the firearm; and an intermediate transfer section that links and transfers the rounds between the ammunition storage device and the loader, the intermediate transfer section having a first two-way round transfer device linked with the ammunition storage device to guide the rounds through a second entry/exit opening, a second two-way round transfer device to guide the rounds between the second entry/exit opening and the loader, a drive shaft that drives the first two-way round transfer device, the second two-way round transfer device and at least the respective round transport assembly to selectively transfer the rounds between the loader and the selected magazine, and a synchronizer linked to the two magazines that maintains a nonselected other of the two magazines in synchronization with the first two-way transfer device during movement of the firearm in elevation.

2. The system of claim 1, wherein the intermediate transfer section includes a first starwheel disposed adjacent the first entry/exit opening, a first round transfer loop and a second starwheel, the second starwheel being disposed between the first starwheel and the first round transfer loop and operatively linked to the first starwheel, and wherein the first starwheel, the second starwheel and the first round transfer loop are shaped to receive and to transfer the rounds.

3. The system of claim 2, wherein the first starwheel is rotatably supported by a first shaft that extends substantially parallel to the elevation axis at a point adjacent the first entry/exit opening.

4. The system of claim 3, wherein the second starwheel is rotatably supported by a second shaft parallel to the first shaft.

5. The system of claim 4, wherein the first round transfer loop engages a first pinion disposed to pivot as the firearm moves in elevation about a point coincident with the elevation axis and a second pinion disposed on and to rotate with the second shaft.

6. The system of claim 5, wherein the intermediate transfer section includes a first central pinion disposed to rotate on the first shaft and a second central pinion disposed to rotate on the second shaft in engagement with the first central pinion, whereby the first and second starwheels rotate approximately simultaneously in opposite directions with rotation of the first and second central pinions, respectively.

7. The feed system of claim 6, further comprising a round counter adjacent the first entry/exit opening that counts the rounds passing therethrough.

8. The feed system of claim 7, wherein the first central pinion includes bosses corresponding to spaces for rounds on the first starwheel, and wherein the counter includes a detector for counting the number of bosses that rotate by the detector during at least one of a round loading or a round unloading operation.

9. The feed system of claim 8, wherein the detector is connected to a disk-shaped plate having a toothed periphery, the disk-shaped plate being free to rotate about the first shaft such that the toothed periphery engages the upper pinion of the nonselected magazine.

10. The system of claim 6, wherein the intermediate transfer section includes a safety device engageable to lock the first central pinion to the first starwheel such that the first central pinion and the first starwheel rotate together.

11. The system of claim 10, wherein the safety device includes a movable pin activatable by an electromagnet to engage a curved groove of the first central pinion.

12. The system of claim 6, wherein the second two-way round transfer device of the intermediate transfer section includes a second round transfer loop that engages a first upper pinion disposed adjacent the second entry/exit opening and a second upper pinion disposed adjacent the loader.

13. The system of claim 6, wherein the second starwheel rotates about the second shaft and the first round transfer loop circulates about the second pinion upon engagement of the first central pinion with the second central pinion.

14. The system of claim 1, wherein the intermediate transfer section includes an articulated bracket connected to the loader, the articulated bracket having a hollow body within which the second part of the intermediate transfer section is disposed.

15. The system of claim 1, wherein the second two-way round transfer device of the intermediate transfer section includes a second round transfer loop that engages a first upper pinion disposed adjacent the second entry/exit opening and a second upper pinion disposed adjacent the loader.

16. The system of claim 15, wherein the first two-way round transfer device includes a first coupling pinion coaxial with a first pinion and the second two-way round transfer device includes a second coupling pinion coaxial with the first upper pinion, and wherein the first coupling pinion is engageable with the second coupling pinion such that the first round transfer loop circulates in synchronization with the second round transfer loop.

17. The system of claim 1, wherein each of said two magazines of the ammunition storage device includes a magazine round transfer loop linking an upper magazine pinion to a lower magazine pinion, the upper magazine pinion and the lower magazine pinion being disposed to rotate on respective upper and lower shafts extending substantially parallel to the elevation axis.

18. The system of claim 17, wherein the first round transfer loop, the second round transfer loop and the magazine transfer loop in each of the two magazines include radial catches shaped to receive and transfer rounds of ammunition.

19. The system of claim 17, wherein the ammunition storage device includes a selector for selecting one of the two magazines, the selector including magazine drive pinions connected to and disposed to drive each upper shaft and a coupling device to couple the upper pinion of the selected one of the magazines with a first central pinion of the intermediate transfer section such that the magazine round transfer loop circulates in synchronization with rotation of a first starwheel coupled to the first central pinion.

20. The system of claim 19, wherein the synchronization device includes two elongate racks, each elongate rack being movable and having a first rack portion disposed to engage a synchronization pinion that pivots as the firearm moves in elevation and is disposed coaxially with the elevation axis and a second rack portion disposed to engage the respective upper pinion of the two magazines, and wherein when the upper pinion of the selected one of the two magazines engages the first central pinion and the synchronization pinion pivots when the firearm moves in elevation, a respective one of the two elongate racks urges the upper pinion of the nonselected one of the two magazines to rotate in synchronization with the intermediate transfer section.

21. The system of claim 1, further comprising an auxiliary magazine linked to and between the intermediate transfer section and the loader.

22. Apparatus for feeding rounds of ammunition in a firearm pivotable about a horizontal elevation axis, comprising:

means for transferring rounds with a two-way round transfer device through a common entry/exit opening of two magazines between a selected one of the two magazines and a firearm chamber loader; and means for synchronizing the two-way round transfer device with a transfer device associated with a nonselected other of the two magazines, the means for synchronizing acting in response to a change in elevation of the firearm.

23. A method of feeding rounds of ammunition in a firearm pivotable about a horizontal elevation axis, comprising:

transferring rounds with a two-way round transfer device through a common entry/exit opening of two magazines between a selected one of the two magazines and a firearm chamber loader; and synchronizing the two-way round transfer device with a transfer device associated with a nonselected other of the two magazines in response to a change in elevation of the firearm.

* * * * *